US008154476B2

(12) United States Patent
Shirai et al.

(10) Patent No.: US 8,154,476 B2
(45) Date of Patent: Apr. 10, 2012

(54) PLASMA DISPLAY DEVICE

(75) Inventors: Tetsuya Shirai, Osaka (JP); Katsutoshi Shindo, Kyoto (JP)

(73) Assignee: Panasonic Corporation, Osaka (JP)

( * ) Notice: Subject to any disclaimer, the term of this patent is extended or adjusted under 35 U.S.C. 154(b) by 710 days.

(21) Appl. No.: 12/088,760

(22) PCT Filed: Feb. 27, 2007

(86) PCT No.: PCT/JP2007/053565

§ 371 (c)(1),
(2), (4) Date: Mar. 31, 2008

(87) PCT Pub. No.: WO2007/102329

PCT Pub. Date: Sep. 13, 2007

(65) Prior Publication Data

US 2009/0153440 A1 Jun. 18, 2009

(30) Foreign Application Priority Data

Feb. 28, 2006 (JP) ..... 2006-051743

(51) Int. Cl.
*G09G 3/28* (2006.01)

(52) U.S. Cl. ..... 345/60; 313/491

(58) Field of Classification Search ..... 345/37, 345/41, 60–72; 315/169.1, 169.4; 313/491
See application file for complete search history.

(56) References Cited

U.S. PATENT DOCUMENTS 3,881,131 A * 4/1975 Schott ..... 315/275
6,424,095 B1 * 7/2002 Hirao et al. ..... 315/169.4
6,479,932 B1 * 11/2002 Nunomura ..... 313/582
2003/0090212 A1 * 5/2003 Park et al. ..... 315/169.1
2004/0251847 A1 12/2004 Yoo
2004/0263078 A1 12/2004 Woo et al.
2005/0052137 A1 * 3/2005 Kwon et al. ..... 313/584
2005/0077824 A1 * 4/2005 Kim et al. ..... 313/583
2005/0225246 A1 10/2005 Kim et al.
2006/0113914 A1 * 6/2006 Fujitani et al. ..... 313/586
2006/0170357 A1 * 8/2006 Hur et al. ..... 313/585

(Continued)

FOREIGN PATENT DOCUMENTS

EP 1 775 699 A1 4/2007

(Continued)

OTHER PUBLICATIONS

International Search Report for PCT/JP2007/053565, dated Jun. 5, 2007.

(Continued)

*Primary Examiner* — Alexander Eisen
*Assistant Examiner* — Sanjiv D Patel
(74) *Attorney, Agent, or Firm* — RatnerPrestia

(57) ABSTRACT

A plasma display device includes plasma display panel and a data driver. Plasma display panel includes a front substrate and a rear substrate faced to each other to form a discharge space therebetween. The front substrate includes a plurality of display electrodes, each having scan electrode and sustain electrode. The rear substrate includes a plurality of data electrodes intersected with the display electrodes. Discharges cells are formed at the intersections of the display electrodes and data electrodes. Data electrodes have a plurality of main electrode parts) formed in portions facing the display electrodes, and wiring parts that connect main electrode parts and have a width smaller than the widths of main electrode parts. Further, the corner of main electrode part is chamfered.

3 Claims, 8 Drawing Sheets

U.S. PATENT DOCUMENTS

| | | | | |
|---|---|---|---|---|
| 2006/0186814 | A1* | 8/2006 | Kwon | 313/583 |
| 2006/0244679 | A1* | 11/2006 | Kim et al. | 345/37 |
| 2007/0279321 | A1* | 12/2007 | Ryu et al. | 345/41 |

FOREIGN PATENT DOCUMENTS

| | | | |
|---|---|---|---|
| JP | 2000-100338 | A | 4/2000 |
| JP | 2001-222959 | A | 8/2001 |
| JP | 2001-222959 | A | 8/2001 |
| JP | 2003-131580 | A | 5/2003 |
| JP | 2003-331731 | A | 11/2003 |
| JP | 2003-331731 | A | 11/2003 |
| JP | 2004-253334 | A | 9/2004 |
| JP | 2004-253334 | A | 9/2004 |
| KR | 10-2004-0048607 | | 6/2004 |
| KR | 10-2004-0048607 | A | 6/2004 |

OTHER PUBLICATIONS

JP Office Action for 2008-503782, Aug. 3, 2010.
Supplementary European Search Report for Application No. EP 07 71 4958, Jan. 14, 2011, Panasonic Corporation.
CN Office Action for 2008-503782, Aug. 3, 2010.

* cited by examiner

PLASMA DISPLAY DEVICE

This application is a U.S. National Phase Application of PCT International Application PCT/JP2007/053565.

TECHNICAL FIELD

The present invention relates to a plasma display device in which a plasma display panel is used as a display device.

BACKGROUND ART

The plasma display panels (hereinafter also referred to as "panel") conventionally for use in a plasma display device are roughly classified into an AC type and a DC type having different driving methods. The panels also fall into two types having different discharge systems: a surface discharge type and an opposite discharge type. The current mainstream of the panels is the surface discharge type having a three-electrode structure because this type has higher definition, a larger screen, and simpler manufacturing method.

A surface discharge plasma display panel is structured so that a pair of substrates having a transparent one at least on the front side thereof is faced to each other to form a discharge space therebetween. Further, barrier ribs for partitioning the discharge space into a plurality of spaces are formed on the substrates. Electrode groups are formed on each of the substrates so that discharge occurs in the discharge space partitioned by the barrier ribs. Further, phosphor layers that emit red, green, or blue light are provided in the discharge space. Thus, a plurality of discharge cells is formed. The phosphors are excited by vacuum ultraviolet light that has a short wavelength and is generated by the discharge. Then, the discharge cells having phosphors for emitting red, green, and blue light (red discharge cells, green discharge cells, and blue discharge cells) generate red, green, and blue visible light, respectively. Thus, color display is provided in the panel.

Such a plasma display panel can provide faster display and a larger angle of field than a liquid crystal panel. The screen size thereof can be increased more easily. Further, the plasma display panel is the self-luminous type, and thus has high display quality. For these reasons, recently, the plasma display panel has been drawing attention particularly among flat panel displays and finding a wide rage of applications, as a display device in a place many people gather or a display device with which people enjoy images on a large screen at home.

In a conventional plasma display device, a panel is held on the front side of a chassis member, and a circuit board is disposed on the rear side of the chassis member. Thus, a module is formed. The panel is predominantly made of glass, and the chassis member is made of a metal, such as aluminum. The circuit board constitutes a driver circuit for causing the panel to emit light. With advancement of increasing the screen size and definition of a plasma display device, popularization in household thereof increases demand for higher image quality and lower power consumption. A conventional panel and a plasma display device using the panel are disclosed in Japanese Patent Unexamined Publication No. 2003-131580 (Patent Document 1), for example.

[Patent Document 1] Japanese Patent Unexamined Publication No. 2003-131580

DISCLOSURE OF THE INVENTION

The present invention provides a plasma display device having higher image quality and lower power consumption.

A plasma display device includes a plasma display panel and a data driver. The plasma display panel includes a front substrate and a rear substrate faced to each other to form a discharge space therebetween. The front substrate includes a plurality of display electrodes. The rear substrate includes a plurality of data electrodes intersected with the display electrodes. Discharges cells are formed at the intersections of the display electrodes and data electrodes. The data driver is connected to the data electrodes to supply voltage to the data electrodes. Further, each of the data electrodes has a plurality of main electrode parts formed in portions facing the display electrodes, and wiring parts that connect the plurality of main electrode parts and have widths smaller than the widths of the main electrode parts. Further, the corner of the main electrode part is chamfered. With this structure, a plasma display device having higher image quality and lower power consumption is provided.

REFERENCE MARKS IN THE DRAWINGS

Figure 1:
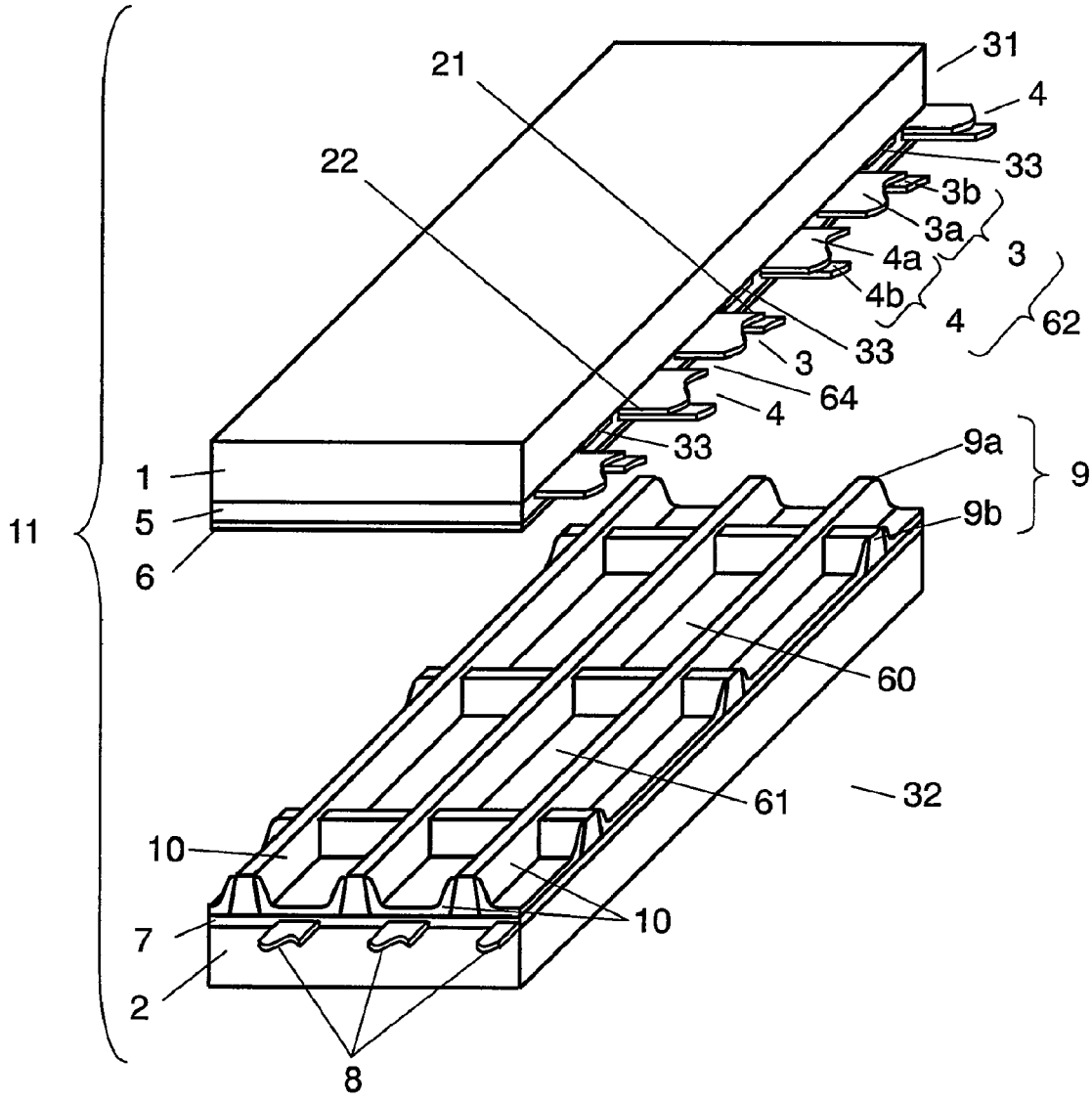
FIG. 1 is a perspective view illustrating an essential part of a plasma display panel for use in a plasma display device in accordance with an exemplary embodiment of the present invention.

1 Front substrate
2 Rear substrate
3 Scan electrode
3*a*, 4*a* Transparent electrode
3*b*, 4*b* Bus electrode
4 Sustain electrode
5 Dielectric layer
6 Protective layer
7 Insulating layer
8 Data electrode
8*a* Main electrode part
8*b* Wiring part
9 Barrier rib
10 Phosphor layer

10B Blue phosphor layer
10R Red phosphor layer
10G Green phosphor layer
11 Plasma display panel
11*b* Central portion
11*c* Peripheral portion
13 Data electrode driver circuit
13*a* Data driver
20 End
20*a* Corner
21, 22 Long side
23 First pattern
24 Second pattern
25 Third pattern
31 Front panel
32 Rear panel
41 First area
42 Second area
43 Third area
60 Discharge space
61, 61R, 61B, 61G Discharge cell
62 Display electrode
63 Plasma display device

DETAILED DESCRIPTION OF PREFERRED EMBODIMENT

Hereinafter, a description of a plasma display device in accordance with the exemplary embodiment of the present invention is provided, with reference to FIGS. 1 through 9C. The present invention is not limited to the following description.

First, a description of a structure of a plasma display panel for use in the plasma display device is provided, with reference to FIG. 1. As shown in FIG. 1, plasma display panel 11 (hereinafter referred to as panel 11) is structured so that front panel 31 and rear panel 32 are faced to each other to form discharge space 60 therebetween. Front panel 31 and rear panel 32 are sealed with a sealing material (not shown) provided along the peripheries of the panels. The examples of the sealing material include a glass frit. A mixed gas of neon (Ne) and xenon (Xe), for example, is filled into discharge space 60.

Front panel 31 is structured in the following manner. Display electrodes 62, each made of scan electrode 3 and sustain electrode 4, are disposed in a plurality of rows, on front substrate 1 made of glass. Sustain electrodes 3 and sustain electrodes 4 constituting display electrodes 62 are disposed in parallel with each other via discharge gaps 64. Dielectric layer 5 made of a glass material is formed to cover scan electrodes 3 and sustain electrodes 4. Further, protective layer 6 made of magnesium oxide (MgO) is formed on dielectric layer 5. In this manner, front panel 31 is formed. Further, each scan electrode 3 has transparent electrode 3*a*, and bus electrode 3*b* formed on transparent electrode 3*a*. Similarly, each sustain electrode 4 has transparent electrode 4*a*, and bus electrode 4*b* formed on transparent electrode 4*a*. Transparent electrodes 3*a* and 4*a* are made of indium tin oxide (ITO) or other materials, and are optically transparent. Bus electrodes 3*b* and 4*b* are predominantly made of a conductive material, such as silver (Ag).

Rear panel 32 is structured in the following manner. A plurality of data electrodes 8 made of a conductive material, such as silver (Ag), are disposed in a stripe pattern on glass rear substrate 2 faced to front substrate 1. Data electrodes 8 are covered with insulating layer 7 made of a glass material. Further formed on insulating layer 7 are barrier ribs 9 made of glass material in a double cross or grid pattern. Barrier ribs 9 are provided to partition discharge space 60 for each discharge cell 61. Further, phosphor layers 10 of red (R), green (G), or blue (B) are provided over the surface of insulating layer 7 between barrier ribs 9 and the side faces of barrier ribs 9. In this manner, rear panel 32 is formed. Front substrate 1 and rear substrate 2 are faced to each other so that data electrodes 8 are intersected with scan electrodes 3 and sustain electrodes 4. Thus, discharge cells 61 partitioned by barrier ribs 9 are formed at the intersections between scan electrodes 3 and sustain electrodes 4, and data electrodes 8.

Further, black light-block layer 33 having high light-blocking effect may be provided between display electrodes 62 and adjacent display electrodes 62 to improve the contrast.

The structure of panel 11 is not limited to the above. For example, panel 11 may be structured to have barrier ribs 9 in a stripe pattern. FIG. 1 shows a structure of display electrodes 62 in which scan electrodes 3 and sustain electrodes 4 are alternately disposed in the following order: scan electrode 3—sustain electrode 4—scan electrode 3—sustain electrode 4, and so on. However display electrodes 62 may be an array of electrodes in the following order: scan electrode 3—sustain electrode 4—sustain electrode 4—scan electrode 3, and so on.

Figure 2:
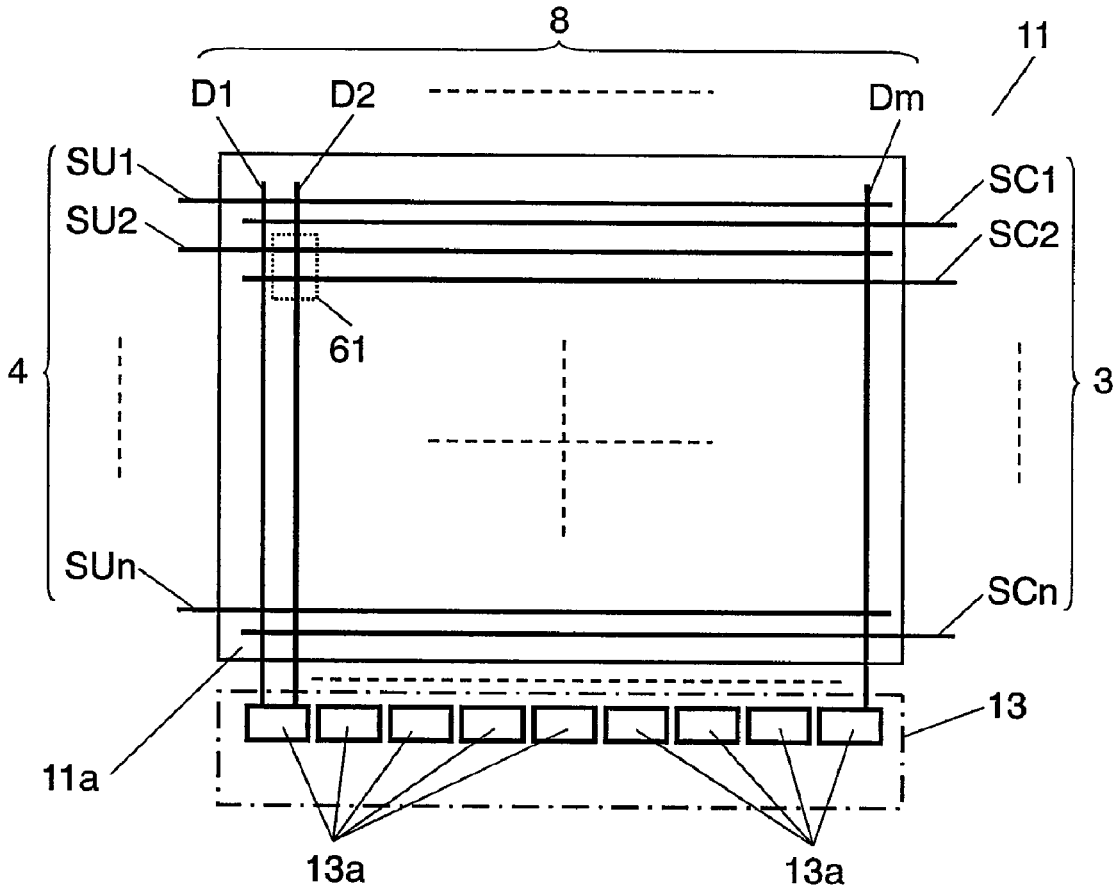
FIG. 2 is an electrode array diagram illustrating an array of electrodes of the plasma display panel of FIG. 1.

FIG. 2 is a schematic electrode array diagram of plasma display panel 11 of FIG. 1. N scan electrodes SC 1 to SCn, i.e. scan electrodes 3, and n sustain electrodes SU 1 to SUn, i.e. sustain electrodes 4, are disposed in the row (vertical) direction. Further, m data electrodes D1 to Dm, i.e. data electrodes 8, are disposed in the column (horizontal) direction. Discharge cell 61 is formed in a portion in which a pair of scan electrode SCi and sustain electrode SUi (i=1 to n) intersects one data electrode Dj (j=1 to m). Thus, m×n discharge cells 61 are formed in discharge space 60. These m×n discharge cells 61 form a display area in which images are displayed.

Figure 3:
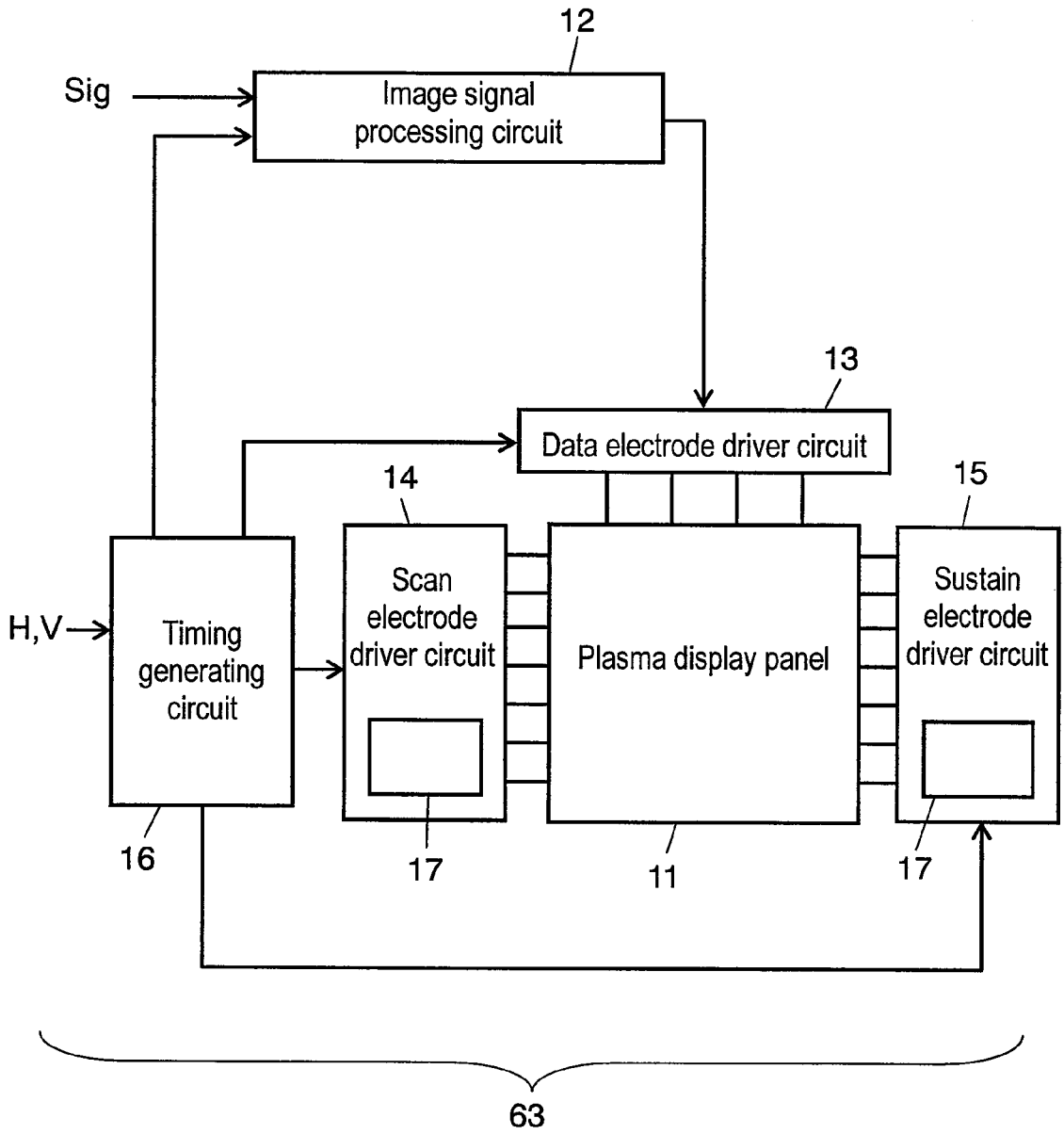
FIG. 3 is a circuit block diagram of the plasma display device in accordance with the exemplary embodiment of the present invention.

FIG. 3 is a circuit block diagram of a plasma display device in which plasma display panel 11 is used. Plasma display device 63 includes panel 11, and various electrical circuits for driving panel 11. The various electrical circuits include image signal processing circuit 12, data electrode driver circuit 13, scan electrode driver circuit 14, sustain electrode driver circuit 15, timing generating circuit 16, and power supply circuits (not shown).

As shown in FIG. 2, data electrode driver circuit 13 is coupled to one ends of data electrodes 8. Data electrode driver circuit 13 includes a plurality of data drivers 13*a* for supplying voltage to data electrodes 8 and made of semiconductor devices. Data electrodes 8 are divided into a plurality of blocks so that one block has a plurality of data electrodes 8. Each block has one data driver 13*a*. Data driver 13*a* is coupled to an electrode lead part that is led out from data electrodes 8 at bottom end 11*a* of panel 11.

With reference to FIG. 3, timing generating circuit 16 generates various kinds of timing signals based on horizontal synchronizing signal H and vertical synchronizing signal V, and feeds the timing signals to the respective driver circuit blocks, i.e. image signal processing circuit 12, data electrode driver circuit 13, scan electrode driver circuit 14, and sustain electrode driver circuit 15. Image signal processing circuit 12 converts image signal Sig into image data for each sub-field. Data electrode driver circuit 13 converts the image data for each sub-field into signals corresponding to respective data electrodes D1 to Dm. By using the signals converted by data electrode driver circuit 13, respective data electrodes D1 to Dm are driven. Scan electrode driver circuit 14 supplies a driving voltage waveform to scan electrodes SC1 to SCn based on the timing signals supplied from timing generating circuit 16. Similarly, sustain electrode driver circuit 15 supplies a driving voltage waveform to sustain electrodes SU1 to SUn based on the timing signals supplied from timing generating circuit 16. Each of scan electrode driver circuit 14 and sustain electrode driver circuit 15 has sustain pulse generating circuit 17 therein.

Figure 4:
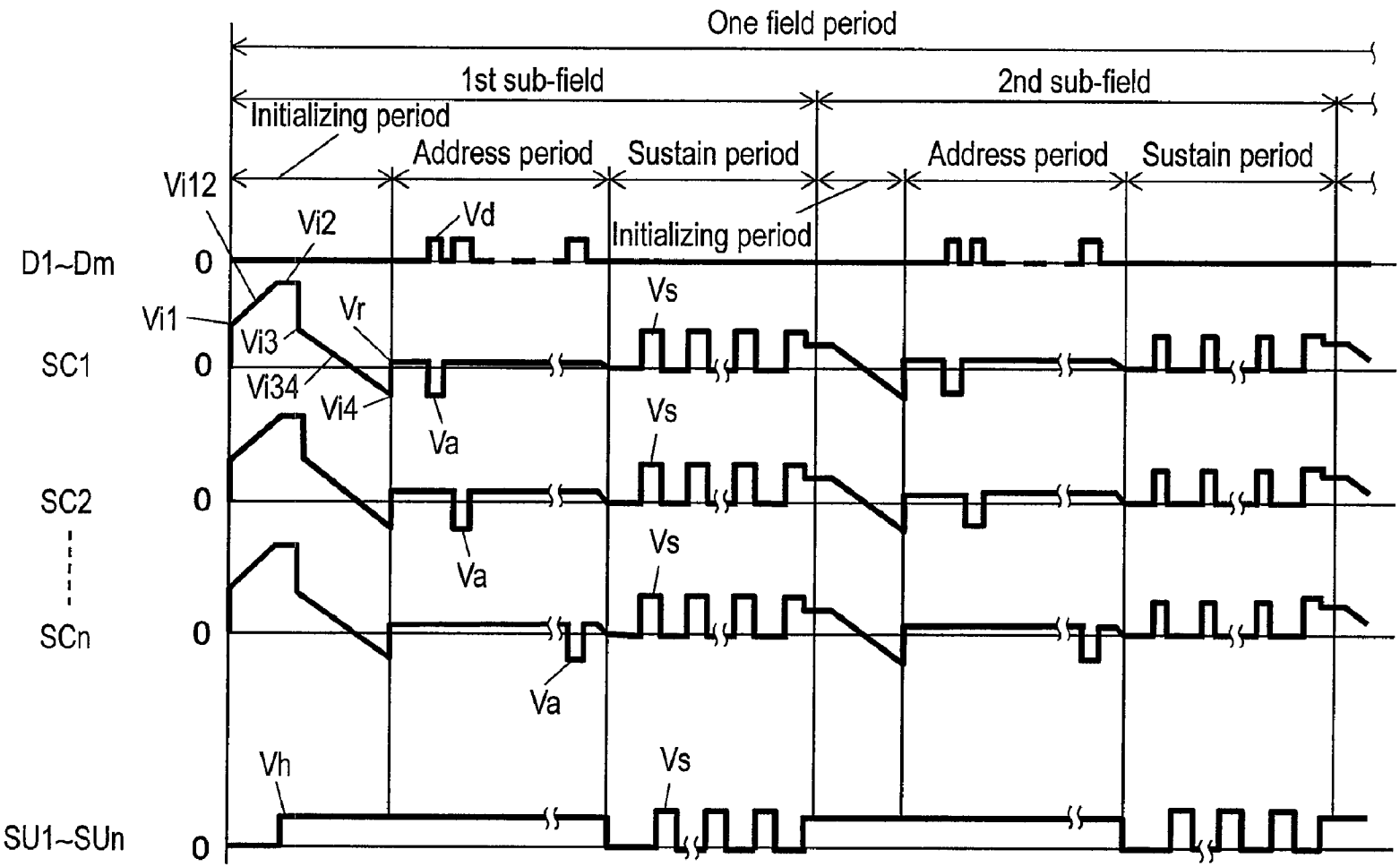
FIG. 4 is a voltage waveform chart showing driving voltage waveforms to be applied to the respective electrodes of the plasma display panel of FIG. 1.

Next, a description of the driving voltage waveforms for driving panel 11 and the operation of panel 11 is provided, with reference to FIG. 4. FIG. 4 is a waveform chart showing the driving voltage waveforms to be applied to the respective electrodes of panel 11.

In a method of driving plasma display device 63, one field period is divided into a plurality of sub-fields, and each sub-field has a initializing period, an address period, and a sustain period.

In the initializing period in the first sub-field, at first, data electrodes D1 to Dm and sustain electrodes SU1 to SUn are kept at 0 (V). Applied to scan electrodes SC1 to SCn at this time is ramp voltage Vi12 that gradually increases from voltage Vi1 (V) of a breakdown voltage or lower to voltage Vi2 (V) exceeding the breakdown voltage. This application causes the first weak initializing discharge in all discharge cells 61, and accumulates negative wall voltage on scan electrodes SC1 to SCn. At this time, positive wall voltage is accumulated on sustain electrodes SU1 to SUn and data electrodes D1 to Dm. Now, the wall voltage on the electrodes indicates the voltage generated by the wall charge accumulated on dielectric layer 5, phosphor layers 10, or the like covering the electrodes.

Thereafter, sustain electrodes SU1 to SUn are kept at positive voltage Vh (V). Applied to scan electrodes SC1 to SCn is ramp voltage V134 gradually decreasing from voltage Vi3 (V) to voltage Vi4 (V). This application causes the second weak initializing discharge in all discharge cells 61, and weakens the wall voltage on scan electrodes SC1 to SCn and sustain electrodes SU1 to SUn. Further, the wall voltage on data electrodes D1 to Dm is adjusted to a value appropriate for addressing operation.

Next, in the address period in the first sub-field, scan electrodes SC1 to SCn are held at voltage Vr (V) once. Then, negative scan pulse voltage Va (V) is applied to scan electrode SC1 in the first row. Positive address pulse voltage Vd (V) is applied to data electrode Dk (k=1 to m) of discharge cell 61 to be lit in the first row among data electrodes D1 to Dm. At this time, the voltage at the intersection of data electrode Dk and scan electrode SC1 amounts to the addition of externally applied voltage (Vd−Va) (V) and the wall voltage on data electrode Dk and scan electrode SC1, thus exceeding the breakdown voltage. Then, addressing discharge occurs between data electrode Dk and scan electrode SC1, and between sustain electrode SU1 and scan electrode SC1. Thus, in discharge cell 61 having generated addressing discharge, positive wall voltage is accumulated on scan electrode SC1, negative wall voltage is accumulated on sustain electrode SU1, and negative wall voltage is accumulated on data electrode Dk.

In this manner, the addressing operation is performed so that addressing discharge occurs in discharge cells 61 to be lit in the first row, and wall voltage is accumulated on the corresponding electrodes. On the other hand, the voltage at the intersections between data electrodes D1 to Dm to which no address pulse voltage Vd (V) is applied and scan electrode SC1 does not exceed the breakdown voltage, thus causing no addressing discharge. Similarly, the addressing operation is sequentially performed on discharge cells 61 in the second row to n-th row. Thus, the address period in the first sub-field is completed.

Next, in the sustain period in the first sub-field, positive sustain pulse voltage Vs (V) is applied to scan electrodes SC1 to SCn, as a first voltage. Then, a ground voltage, i.e. 0 (V), is applied to sustain electrodes SU1 to SUn, as a second voltage. At this time, in discharge cell 61 having generated addressing discharge in the address period, the voltage between scan electrode SCi and sustain electrode SUi amounts to the addition of scan pulse voltage Vs (V) and the wall voltage on scan electrode SCi and sustain electrode SUi, thus exceeding the breakdown voltage. Thereby, sustaining discharge occurs between scan electrode SCi and sustain electrode SUi, and the ultraviolet light generated by the sustaining discharge excites phosphor layers 10 so that they emit light. Then, negative wall voltage is accumulated on scan electrode SCi and positive wall voltage is accumulated on sustain electrode SUi. At the same time, positive wall voltage also accumulates on data electrode Dk.

In discharge cells 61 having generated no addressing discharge in the address period, no sustaining discharge occurs and the wall voltage at the completion of the initializing period is kept. Successively, the second voltage, i.e. 0 (V), is applied to scan electrodes SC1 to SCn. At the same time, the first voltage, i.e. sustain pulse voltage Vs (V), is applied to sustain electrodes SU1 to SUn. Thus, in discharge cells 61 having generated sustaining discharge before, the voltage between sustain electrode SUi and scan electrode SCi exceeds the breakdown voltage. As a result, sustaining discharge occurs between sustain electrode SUi and scan electrode SCi again. Negative wall voltage is accumulated on sustain electrode SUi, and positive wall voltage is accumulated on scan electrode SCi.

Thereafter, sustain pulse voltage Vs (V) in the number corresponding to the brightness weight is alternately applied to scan electrodes SC1 to SCn and sustain electrodes SU1 to SUn, in a similar manner. This application allows continuous sustaining discharge in discharge cells 61 having generated addressing discharge in the address period. Thus, the sustaining operation in the sustain period is completed.

In the succeeding second sub-field, the operation is performed in the initializing period, address period, and sustain period, in a manner substantially similar to the first sub-field. The operation in the third sub-field and thereafter is performed in a similar manner. Thus, the description is omitted.

Next, the structure of panel 11 in plasma display device 63 of the present invention is further detailed, with reference to FIGS. 5 through 9C.

Figure 5:
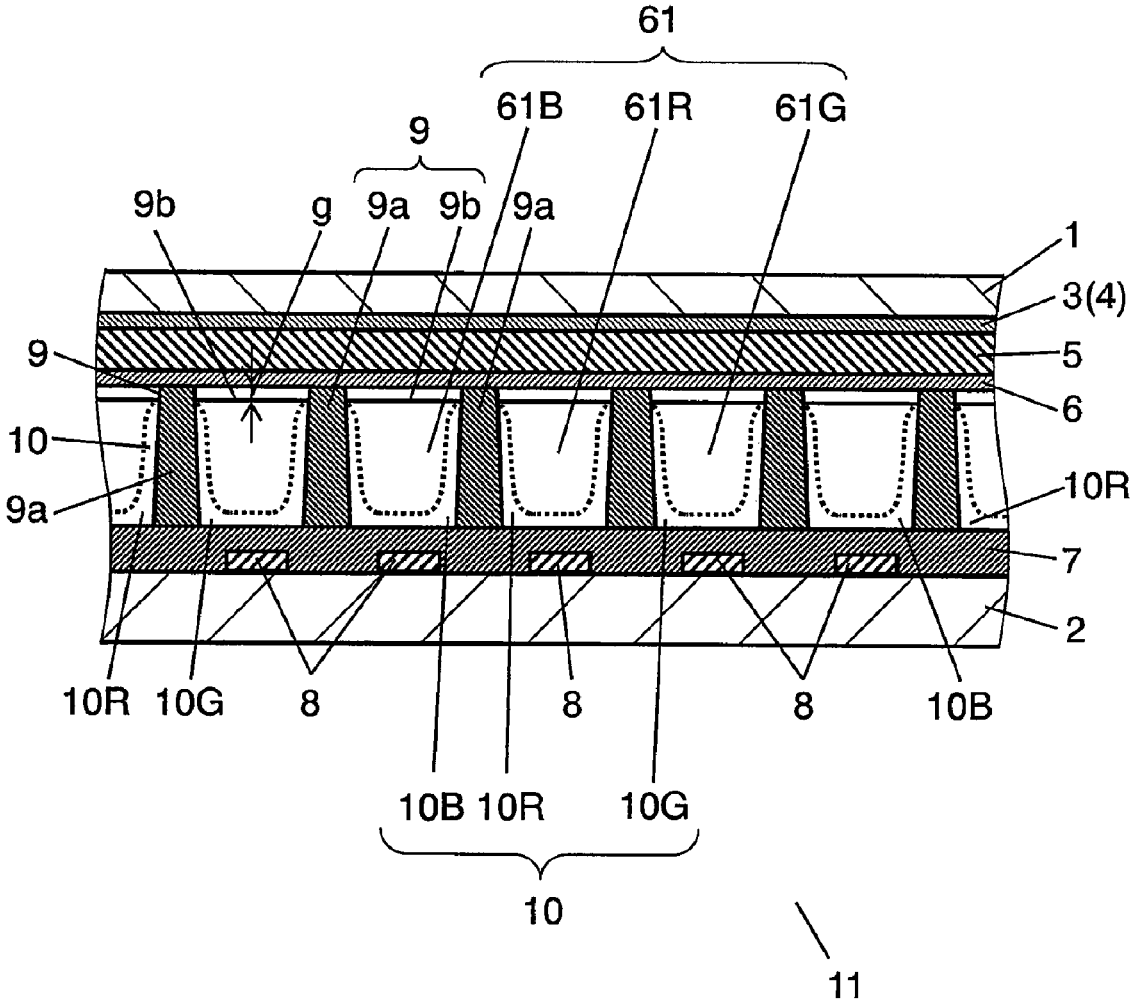
FIG. 5 is a sectional view illustrating a structure of discharge cells of the plasma display panel for use in the plasma display device in accordance with the exemplary embodiment of the present invention.
Figure 6:
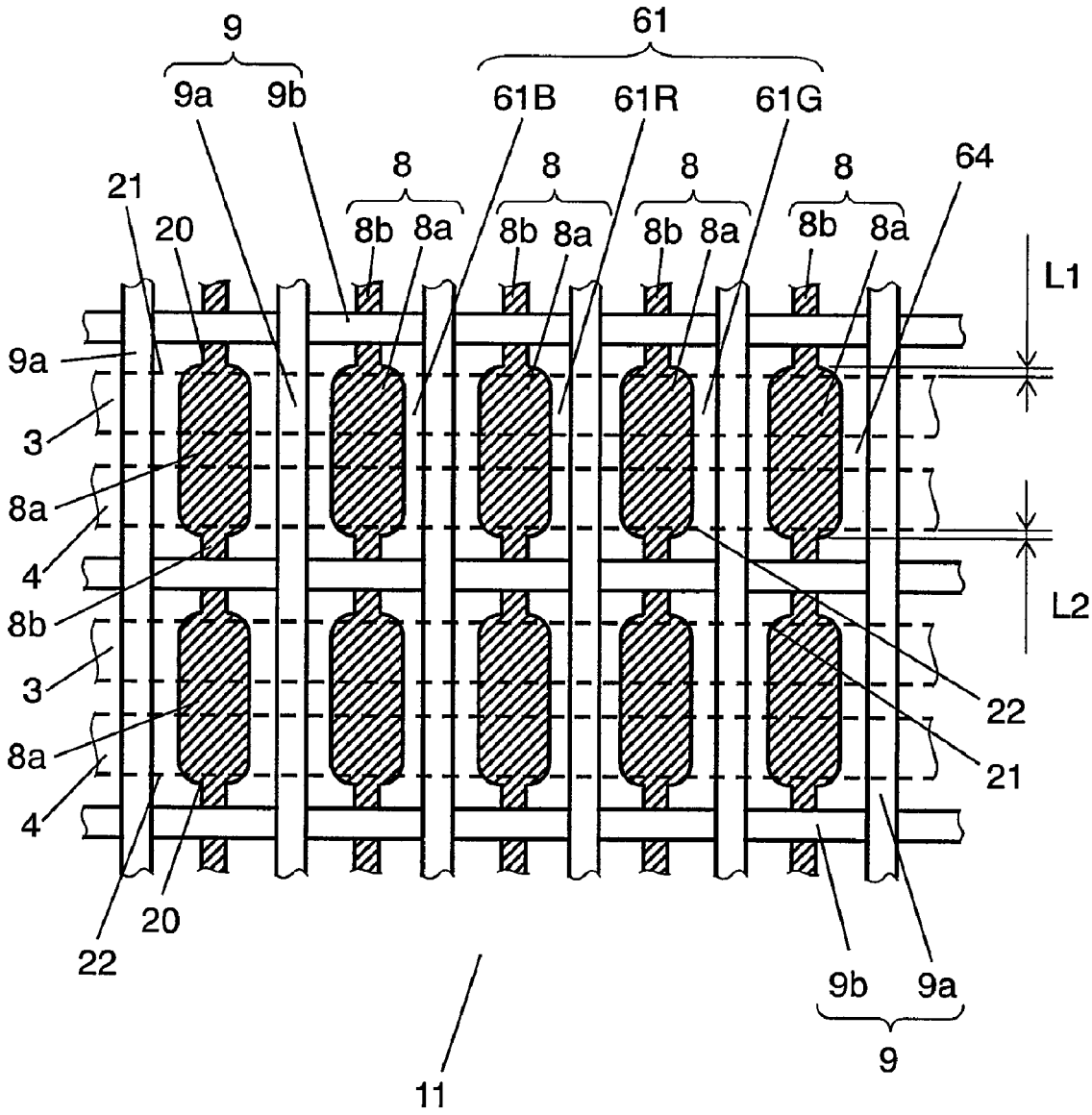
FIG. 6 is a plan view illustrating the structure of the discharge cells of FIG. 5.
Figure 7:
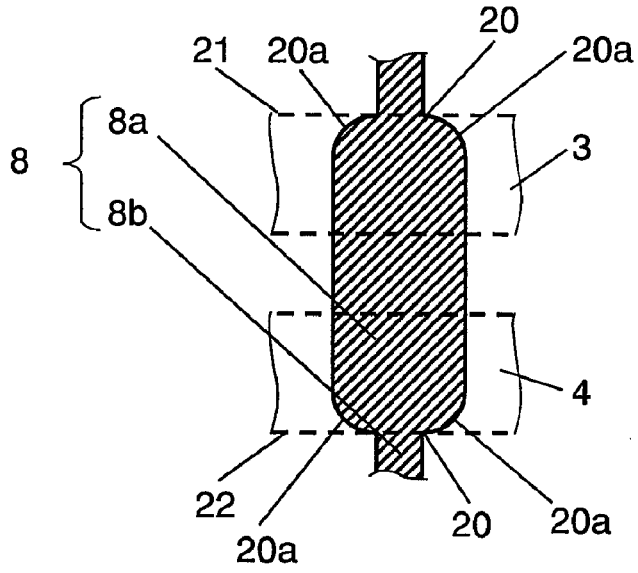
FIG. 7 is a plan view illustrating a structure of an essential part of the data electrode of the plasma display panel of FIG. 5.

FIG. 5 is a sectional view illustrating the structure of panel 11 for use in plasma display device 63 in accordance with the exemplary embodiment. FIG. 6 is a plan view illustrating the structure of discharge cells 61 in panel 11 of FIG. 5. FIG. 7 is a plan view illustrating a structure of an essential part of data electrode 8 of panel 11.

With reference to FIGS. 5 through 7, barrier ribs 9 that form discharge cells 61 in a grid or double cross pattern include vertical ribs 9*a* and horizontal ribs 9*b*. Vertical ribs 9*a* are formed in parallel with data electrodes 8. Horizontal ribs 9*b* are orthogonal to and lower than vertical ribs 9*a*. Thus, gap g is formed between horizontal ribs 9*b* and protective layer 6. Phosphor layers 10 applied to the inside of barrier ribs 9 are formed of blue phosphor layers 10B, red phosphor layers 10R, and green phosphor layers 10G in a stripe pattern of this order along vertical ribs 9*a*. Further, for blue phosphor layer 10B, red phosphor layer 10R, and green phosphor layer 10G formed in a stripe pattern, barrier ribs 9 are disposed so that red phosphor layer 10R is narrower than blue phosphor layer 10B and green phosphor layer 10G. In other words, light-emitting area of red (R) discharge cell 61R is smaller than the light-emitting area of each of blue (B) discharge cell 61B and green (G) discharge cell 61G. With this structure, the luminescent color of panel 11 can be adjusted to an appropriate color temperature.

As shown in FIGS. 6 and 7, data electrode 8 includes main electrode parts 8*a* and wiring parts 8*b*. Each of main electrode parts 8*a* is formed in a portion in which data electrode 8 is faced to scan electrode 3 and sustain electrode 4. Wiring parts 8*b* connect a plurality of main electrode parts 8*a* together. In other words, main electrode part 8*a* is formed in each discharge cell 61. Wiring parts 8*b* are formed in portions other than main electrode parts 8*a* in each data electrode 8. Further, main electrode part 8*a* is wider than wiring part 8*b*. In other words, the width of wiring part 8*b* is smaller than the width of main electrode part 8*a*.

Further, each main electrode part 8*a* has ends 20 in the longitudinal direction of data electrode 8. Ends 20 are substantially aligned with long side 21 of scan electrode 3 and long side 22 of sustain electrode 4. Long side 21 and long side 22 are the long sides of a pair of scan electrode 3 and sustain electrode 4, respectively, in each discharge cell 61. Long side 21 and long side 22 are the long side of scan electrode 3 and the long side of sustain electrode 4, respectively, on the sides separated at the furthest distance in discharge cell 61.

As the length of main electrode part 8*a* (the length along the longitudinal direction of data electrode 8) increases, the data current increases. In contrast, as the length of main electrode part 8*a* decreases, the address pulse voltage necessary for addressing discharge increases, and thus addressing operation is destabilized. For this reason, a structure in which ends 20 of each main electrode part 8*a* are substantially aligned with long side 21 of scan electrode 3 and long side 22 of sustain electrode 4 allows addressing operation with fewer failures. This structure can also decrease the data current flowing through the data electrodes during addressing operation, and thus provide a plasma display device having higher image quality and lower power consumption.

To provide such an advantage, preferably, positional deviation amount L1 between end 20 of main electrode part 8*a* and long side 21 of scan electrode 3 is 50 μm or smaller, and positional deviation amount L2 between end 20 and long side 22 of scan electrode 4 is 50 μm or smaller. FIG. 6 shows a case in which ends 20 of main electrode part 8*a* are disposed outside of long sides 21 and 22 in each discharge cell 61. Preferably, also when ends 20 of each main electrode part 8*a* are disposed inside of long sides 21 and 22, the positional deviation amount is 50 μm or smaller. In other words, when the positional deviation amount (along the longitudinal direction of data electrode 8) between end 20 of main electrode part 8*a* and long side 21 of scan electrode 3 is 50 μm or smaller, end 20 is substantially aligned with long side 21. When the positional deviation amount (along the longitudinal direction of data electrode 8) between end 20 of main electrode part 8*a* and long side 22 of sustain electrode 4 is 50 μm or smaller, end 20 is substantially aligned with long side 22.

Further, ends 20 of main electrode part 8*a* need not be substantially aligned with long side 21 of scan electrode 3 and long side 22 of sustain electrode 4 in every discharge cell 61 of panel 11 having a large screen. The variation may vary between discharge cells 61 of panel 11. In short, the structure of the panel designed according to the idea that ends 20 of each main electrode part 8*a* are substantially aligned with long side 21 of scan electrode 3 and long side 22 of sustain electrode 4 can satisfy the structure of the present invention.

Further, as shown in FIGS. 6 and 7, each corner 20*a* of main electrode part 8*a* may be chamfered to have an arc shape having a curvature. Corner 20*a* of main electrode part 8*a* shaped to have the right angle, for example, may peel off when data electrode 8 is formed. This peeling causes variations in the shape of main electrode part 8*a* between the discharge cells, thus causing variations in the address pulse voltage. Thereby, the driving margin during addressing operation is decreased. Further, during the aging process, a process of manufacturing the panel, electric field concentration on corners 20*a* may cause sparks between scan electrodes 3 or sustain electrodes 4 and data electrodes 8, and breakage of insulating layer 7, although such a phenomenon depends on the aging conditions, such as an applied voltage.

However, chamfered corners 20*a* are unlikely to peel off when data electrode 8 is formed, and can secure the driving margin during addressing operation. Further, breakage of insulating layer 7 during the aging process can be inhibited.

As shown in FIG. 2, in plasma display device 63, data drivers 13*a* for supplying voltage to data electrodes 8 are coupled only to one ends of data electrodes 8. In other words, a single scan system is used. With the use of this system, the number of components constituting the driver circuits of plasma display device 63, and the cost of the driver circuits can be reduced. As a result, the cost of plasma display device 63 is reduced.

In the present invention, each data electrode 8 includes main electrode parts 8*a* wider than wiring parts 8*b*, in portions faced to scan electrodes 3 and sustain electrodes 4. Further, ends 20 of each main electrode part 8*a* are substantially aligned with long side 21 of scan electrode 3 and long side 22 of sustain electrode 4. In other words, because the width of wiring part 8*b* is smaller than the width of main electrode part 8*a* to be used for discharge in panel 11, the data current is reduced. According to experimental results, a data current of approximately 230 mA flows when the width of each data electrode 8 is approximately 140 μm and constant. In contrast, when each main electrode part 8*a* is approximately 140 μm wide and each wiring part 8*b* is approximately 80 μm wide, a data current of approximately 200 mA flows. Thus, the data current can be reduced. This structure can provide plasma display device 63 in which a smaller load is imposed on the circuit of data drivers 13*a*, even with the use of the single scan system.

As described above, in plasma display device 63 of the present invention, the data current flowing through data electrodes 8 during addressing operation is reduced. Thus, plasma display device 63 having higher image quality and lower power consumption can be provided.

Further, because data drivers 13*a* for supplying voltage to data electrodes 8 of panel 11 are coupled only to one ends of data electrodes 8, the number of data drivers 13*a* can be reduced in a higher-definition panel 11. Thus, plasma display device 63 having a lower cost can be provided.

Further, the width of data electrodes 8 in central portion 11*b* of panel 11 may be different from the width of data electrodes 8 in peripheral portion 11*c* of panel 11. Hereinafter, a description of this structure is provided, with reference to FIGS. 8, 9A, 9B, and 9C.

Figure 8:
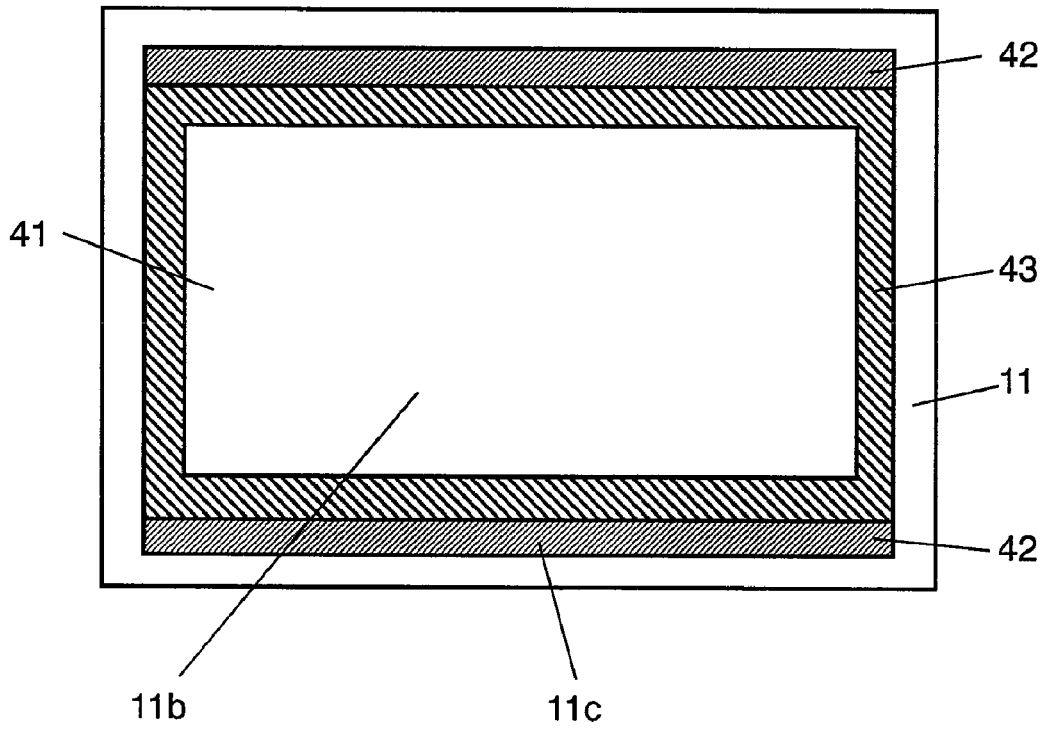
FIG. 8 is a plan view illustrating the plasma display panel for use in the plasma display device in accordance with the exemplary embodiment of the present invention.
Figure 9A:
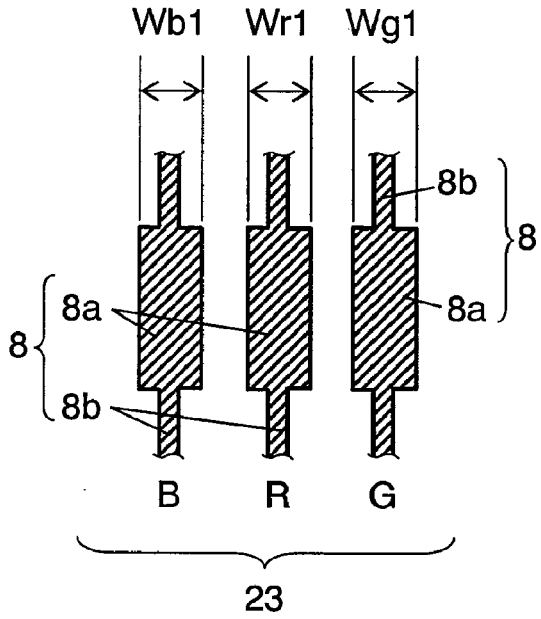
FIG. 9A is a plan view illustrating a pattern of the data electrodes of the plasma display panel of FIG. 8.
Figure 9B:
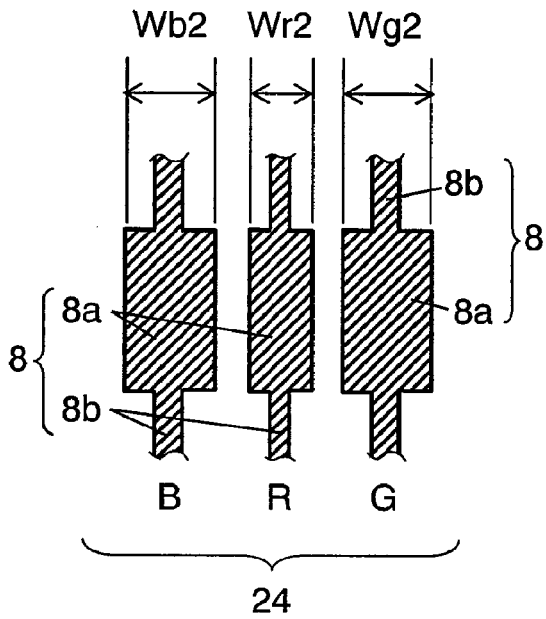
FIG. 9B is a plan view illustrating a pattern of the data electrodes of the plasma display panel of FIG. 8.

With reference to FIG. 8, panel 11 includes first area 41, second area 42, and third area 43. First area 41 is disposed in central portion 11*b* of panel 11. Second area 42 is disposed in peripheral portion 11*c* of panel 11. Third area 43, a transition area, is formed between first area 41 and second area 42. Further, in first area 41, data electrodes 8 having first pattern 23 as shown in FIG. 9A are formed. In second area 42, data electrodes 8 having second pattern 24 as shown in FIG. 9B are formed. In third area 43, data electrodes 8 having third pattern 25 as shown in FIG. 9C are formed.

As shown in FIG. 9A, in data electrodes 8 having first pattern 23, main electrode parts 8*a* corresponding to red (R), green (G), and blue (B) have the same width of Wr1, Wg1, and Wb1, respectively. In other words, a condition of Wr1=Wg1=Wb1 is satisfied.

As shown in FIG. 9B, main electrode part 8*a* corresponding to red (R) in second pattern 24 has width Wr2 equal to width Wr1 of main electrode part 8*a* corresponding to red (R) in first pattern 23. In other words, a relation of Wr1=Wr2 is satisfied. Main electrode part 8*a* corresponding to green (G) in second pattern 24 has width Wg2 larger than width Wg1 of main electrode part 8*a* corresponding to green (G) in first pattern 23. In other words, a relation of Wg1<Wg2 is satisfied. Similarly, main electrode part 8*a* corresponding to blue (B) in second pattern 24 has width Wb2 larger than width Wb1 of main electrode part 8*a* corresponding to blue (B) in first pattern 23. In other words, a relation of Wb1<Wb2 is satisfied.

Figure 9C:
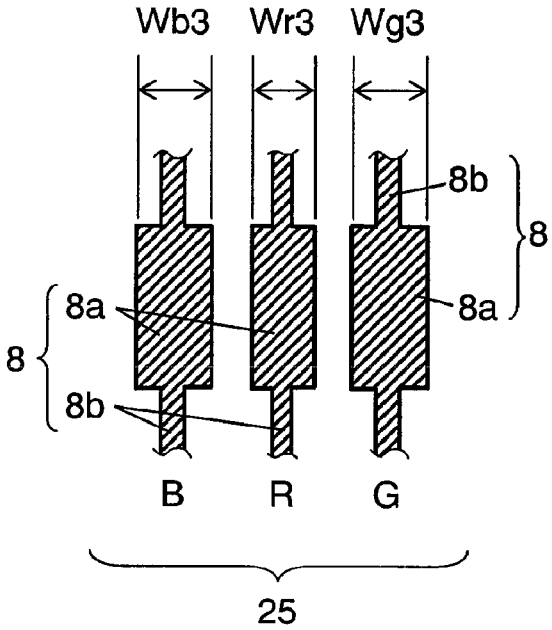
FIG. 9C is a plan view illustrating a pattern of the data electrodes of the plasma display panel of FIG. 8.

Further, as shown in FIG. 9C, main electrode part 8*a* corresponding to red (R) in third pattern 25 has width Wr3 equal to width Wr1 of main electrode part 8*a* corresponding to red (R) in first pattern 23, and equal to width Wr2 of main electrode part 8*a* corresponding to red (R) in second pattern 24. In other words, a relation of Wr1=Wr2=Wr3 is satisfied. Main electrode part 8*a* corresponding to green (G) in third pattern 25 has width Wg3 larger than width Wg1 of main electrode part 8*a* corresponding to green (G) in first pattern 23. At the same time, width Wg3 is smaller than width Wg2 of main electrode part 8*a* corresponding to green (G) in second pattern 24. In other words, a relation of Wg1<Wg3<Wg2 is satisfied. Similarly, main electrode part 8*a* corresponding to blue (B) in third pattern 25 has width Wb3 larger than width Wb1 of main electrode part 8*a* corresponding to blue (B) in first pattern 23. At the same time, width Wb3 is smaller than width Wb2 of main electrode part 8*a* corresponding to blue (B) in second pattern 24. In other words, a relation of Wb1<Wb3<Wb2 is satisfied.

As described above, widths Wb2 and Wg2 of main electrode parts 8*a* corresponding to blue (B) and green (G) in peripheral portion 11*c* of panel 11 are set larger than widths Wb1 and Wg1 of main electrode parts 8*a* in central portion 11*b* of panel 11, respectively (Wg1<Wg2, and Wb1<Wb2). This structure can reduce addressing failures caused by charge decreasing during addressing operation. In other words, in the addressing step of selecting discharge cells 61 to be lit, addressing operation is performed with fewer failures. As a result, plasma display panel 63 having higher image quality can be provided.

Peripheral portion 11*c* of panel 11 may be provided to correspond to the areas in which addressing failures are more likely to be caused by charge decreasing during addressing operation. For example, peripheral portion 11*c* of panel 11 may be set to areas within 5% of the (vertical) length of the display area of panel 11 from the top end and bottom end of the display area.

In the above description, panel 11 has third area 43 formed between first area 41 and second area 42. However, when main electrode parts 8*a* in first area 41 have a small difference in width (10 μm or smaller, for example) from main electrode parts 8*a* in second area 42, third area 43 may be eliminated.

As described above, the present invention can provide plasma display device 63 having higher image quality, lower power consumption, and lower cost.

Industrial Applicability

As described above, the present invention can provide a plasma display device having higher image quality and lower power consumption, and is useful for various kinds of display devices.

The invention claimed is:

1. A plasma display device comprising:

a plasma display panel including:

a front substrate having a plurality of display electrodes formed thereon, each of the display electrodes including a scan electrode and a sustain electrode; and a rear substrate having a plurality of data electrodes formed thereon so that the data electrodes are intersected with the display electrodes, wherein the front substrate and the rear substrate are faced to each other to form a discharge space therebetween so that a plurality of discharge cells are formed at an intersection of respective ones of the plurality of display electrodes and the plurality of data electrodes; and a data driver coupled to the data electrode for supplying voltage to the data electrode, wherein the plasma display panel includes:

a first area disposed in a central portion of the plasma display panel; and a second area disposed in a peripheral portion of the plasma display panel, wherein the plurality of discharge cells includes:

a red discharge cell;

a green discharge cell; and a blue discharge cell, wherein each of the plurality of data electrodes includes:

a main electrode part formed in a position facing the scan electrode and the sustain electrode in the discharge cell; and a wiring part that connects the main electrode parts and has a width smaller than a width of the main electrode part, wherein the main electrode part corresponding to the red discharge cell in a second pattern of the second area has a width equal to a width of the main electrode part corresponding to the red discharge cell in a first pattern of the first area, wherein the main electrode part corresponding to the green discharge cell in the second pattern of the second area has a width larger than a width of the main electrode part corresponding to the green discharge cell in the first pattern of the first area, wherein the main electrode part corresponding to the blue discharge cell in the second pattern of the second area has a width larger than a width of the main electrode part corresponding to the blue discharge cell in the first pattern of the first area, and wherein a corner of the main electrode part is chamfered.

2. The plasma display device of claim 1, wherein the corner of an end in the longitudinal direction of the data electrode has an arc shape having a curvature.

3. The plasma display device of claim 1, wherein the plasma display panel further includes a third area surrounding the first area, and wherein at least one of the main electrode parts provided in the third area of the plasma display panel is larger than a width of the main electrode part provided in the first area of the plasma display panel.

* * * * *